US006779449B1

(12) United States Patent
Hoffmann et al.

(10) Patent No.: US 6,779,449 B1
(45) Date of Patent: Aug. 24, 2004

(54) CARRYING SLEEVE FOR PRINTING AND TRANSFER FORMS AND A PROCESS FOR PRODUCTION OF SUCH A CARRYING SLEEVE

(75) Inventors: Eduard Hoffmann, Bobingen (DE); Wolfgang Prem, Kutzenhausen (DE); Johann Winterholler, Friedberg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 08/856,944

(22) Filed: May 15, 1997

Related U.S. Application Data

(63) Continuation of application No. 08/529,021, filed on Sep. 15, 1995, now abandoned.

(30) Foreign Application Priority Data

Sep. 15, 1994 (DE) ..... 44 32 814

(51) Int. Cl.[7] ..... B41F 13/10
(52) U.S. Cl. ..... 101/375; 101/401.1
(58) Field of Search ..... 101/375, 401.1, 101/415.1, 216, 348, 376, 217, 395

(56) References Cited

U.S. PATENT DOCUMENTS

| | | | | | |
|---|---|---|---|---|---|
| 1,690,684 | A | * | 11/1928 | Johnson | 138/151 |
| 3,610,863 | A | * | 10/1971 | Doublet | 219/61.3 |
| 3,750,250 | A | * | 8/1973 | Brown | 101/401.1 |
| 3,950,839 | A | * | 4/1976 | DuPree et al. | 29/447 |
| 4,106,167 | A | * | 8/1978 | Luc | 29/469.5 |
| 4,183,788 | A | * | 1/1980 | Fromson et al. | 101/454 |
| 4,812,219 | A | * | 3/1989 | Sattrup | 101/375 |
| 4,817,527 | A | | 4/1989 | Wouch et al. | |
| 4,871,650 | A | * | 10/1989 | Wallbillich et al. | 430/300 |
| 4,913,048 | A | * | 4/1990 | Tittgemeyer | 101/141 |
| 4,963,404 | A | * | 10/1990 | Jenkins | 101/348 X |
| 4,964,338 | A | * | 10/1990 | Fantoni et al. | 101/378 |
| 5,093,180 | A | * | 3/1992 | Morgan | 101/217 X |
| 5,147,999 | A | * | 9/1992 | Dekumbis et al. | 219/121.63 |
| 5,207,158 | A | * | 5/1993 | Fadner et al. | 101/348 |
| 5,281,511 | A | * | 1/1994 | Gerhardt | 430/320 |
| 5,289,769 | A | * | 3/1994 | Lewis | 101/218 |
| 5,347,927 | A | * | 9/1994 | Berna et al. | 101/401.1 |
| 5,351,615 | A | * | 10/1994 | Kobler | 101/401.1 |
| 5,398,604 | A | * | 3/1995 | Burke et al. | 101/216 |
| 5,468,568 | A | * | 11/1995 | Kuhn et al. | 101/217 X |
| 5,488,903 | A | * | 2/1996 | Kobler et al. | 101/375 |
| 5,492,059 | A | * | 2/1996 | Reichel | 101/375 |
| 5,507,228 | A | * | 4/1996 | Schulz | 101/375 |

FOREIGN PATENT DOCUMENTS

| | | | | |
|---|---|---|---|---|
| CA | 2076274 | * | 3/1993 | 101/375 |
| CA | 2083682 | | 6/1993 | |
| CA | 2096171 | | 11/1993 | |
| CA | 2127305 | | 1/1995 | |
| DE | 4140768 | | 6/1993 | |
| DE | 4217793 | | 12/1993 | |
| DE | 4311078 | | 5/1994 | |
| DE | 4412873 | | 11/1994 | |
| EP | 0225509 | | 6/1987 | |
| EP | 0571909 | | 12/1993 | |
| FR | 989659 | | 9/1951 | |
| GB | 2200323 | | 8/1988 | |
| JP | 62-270389 | | 11/1987 | |
| WO | 9405507 | | 3/1994 | |

* cited by examiner

*Primary Examiner*—Eugene H. Eickholt
(74) *Attorney, Agent, or Firm*—Cohen, Pontani, Lieberman & Pavane

(57) ABSTRACT

A carrying sleeve, for painting and transfer forms of a metal material, the initial form of which is a rectangular thin-walled flat sheet. The sheet is bent into the desired hollow cylindrical form and the edges of the sheet which point toward one another are permanently connected together. The sleeve surface is processed in order to form a homogeneous continuous outer surface, so that continuous printing can be carried out.

14 Claims, 2 Drawing Sheets

CARRYING SLEEVE FOR PRINTING AND TRANSFER FORMS AND A PROCESS FOR PRODUCTION OF SUCH A CARRYING SLEEVE

This is a continuation, of application Ser. No. 08/529,021, filed Sep. 15, 1995 now abandoned.

BACKGROUND OF THE INVENTION

1. Field of the Invention

The invention relates to a metal carrying sleeve for printing and transfer forms. The initial form of the sleeve is a rectangular, thin-walled flat sheet, which is shaped by bending into the desired hollow cylindrical form, and the edges of the flat sheet which point toward one another are connected permanently together.

2. Description of the Prior Art

It is known today from flexographic printing to place sleeve-type printing and transfer forms on galvanically-produced nickel sleeves. Printing and transfer forms produced in this manner can be slipped by means of pressurized air over a printing cylinder core in the known manner and affixed thereto by shutting off the air supply. Carrying sleeves of fiberglass-reinforced plastic and even of carbon-fiber-reinforced plastic are also used for this purpose. However, it is relatively expensive to use materials such as nickel and fiberglass-reinforced plastic or even carbon-fiber-reinforced plastic for producing carrying sleeves.

German Patent Application P 41 40 768 discloses a sleeve-type offset printing form produced from a rectangularly-cut metal plate, wherein the edges of the plate pointing toward one another are connected by a welded seam. The carrying sleeve produced in this manner is coated and exposed on all sides except for the welded seam.

DE 42 17 793 C1 discloses a sleeve-type offset rubber blanket that is also produced from a cut base plate, to which, while it is flat, a rubber coat is applied, and wherein the beginning and the end of the base plate, along with the rubber coat, are welded together.

Using these sleeve-type printing and transfer forms, it is possible to print in a channel-free fashion,but not continuously, i.e., only finite printing products can be produced. Until now, the use of a continuous offset printing form has not become known.

SUMMARY OF THE INVENTION

Accordingly, it is an object of the present invention is to provide relatively economical carrying sleeves for printing forms and transfer forms, with which continuous printing is possible.

Pursuant to this object, and others which will become apparent hereafter, one aspect of the present invention resides in a metal carrying sleeve for printing and transfer forms, the initial form of which is a rectangular, thin-walled flat sheet. The sheet is bent into the desired hollow cylindrical form and the edges which point toward one another are permanently connected together. The sleeve surface is processed in order to form a homogeneous outer surface so that continuous printing can be carried out. This represents an advantageous alternative to nickel, fiberglass-reinforced plastic and carbon-fiber-reinforced plastic sleeves from both ecological and economic points of view and, in addition, can be used universally for various printing methods.

The production costs for a welded precision sleeve processed according to the invention are many times lower than the production costs for galvanized nickel sleeves or coiled carrying sleeves of fiberglass-reinforced plastic or carbon-fiber-reinforced plastic, especially since it is becoming increasingly difficult to produce nickel sleeves galvanically, because this production method is accompanied by heavy environmental pollution.

Furthermore, in an additional embodiment of the invention, the carrying sleeves are produced from aluminum, steel, high-quality steel, copper or brass, depending on the particular intended use.

In another embodiment of the invention, the entire sleeve surface, including the connecting seam which connects together the edges of the sheet, is chemically roughened, anodized and provided with a final photosensitive coat so that the entire sleeve surface can be used for offset printing. In still a further embodiment of the invention the entire surface of the sleeve, including the connecting seam, is provided with a water conducting coat. This also permits the entire sleeve surface to be used for offset printing.

For use in gravure printing, the entire sleeve surface, including the coating seam, is provided with an engraved copper coat.

In yet a further embodiment of the invention the entire sleeve surface, including the connecting seam, is covered with an endless rubber coat. This arrangement is suitable for use with a transfer form.

In still another embodiment of the invention the carrying sleeve is configured so that it can be used directly as a carrying sleeve of a flexible printing form for flexographic printing.

It is yet another object of the present invention to provide a process for producing the above discussed carrying sleeve for printing and transfer forms. Pursuant to this object, the inventive process includes cutting a base plate corresponding in size to the circumference and breadth of the printing cylinder from thin-walled sheet metal drawn from a roll. Next the base plate is bent into the desired cylindrical form and the edges thereof which are directed toward one another are connected permanently together by a welded seam. The welding is carried out so that a crown is created on the external surface. The entire sleeve surface is processed in order to form a homogeneous, continuous circumferential surface and during this processing the crown is fit into the homogeneous surface.

It is possible to attain the crown of the welded seam in a number of ways. A first possibility is that filler materials can be welded in. In another embodiment the crown is achieved by targeted protective gas feeds. Yet another embodiment of the invention provides the crown by deposit welding which follows the actual welding together of the edges of the plate.

Pursuant to another embodiment of the inventive process, the entire sleeve surface is processed in order to obtain a homogeneous, continuous outer surface. This processing includes chemically roughing and anodizing the hollow cylindrical form of the base plate and subsequently providing the external surface with a photosensitive coating which creates a printing form sleeve suitable for continuous printing. It is desirable to use aluminum as the base plate material.

In yet a further embodiment of the inventive process a metal coat is applied to the processed external surface of the hollow cylindrical form and this metal coat is then mechanically processed. For this it is desirable to use a copper alloy as the metal coat.

Still another embodiment of the inventive process includes applying an endless rubber coating to the entire processed sleeve surface.

Furthermore, it is possible to apply an endless ceramic coat to the entire processed sleeve surface.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
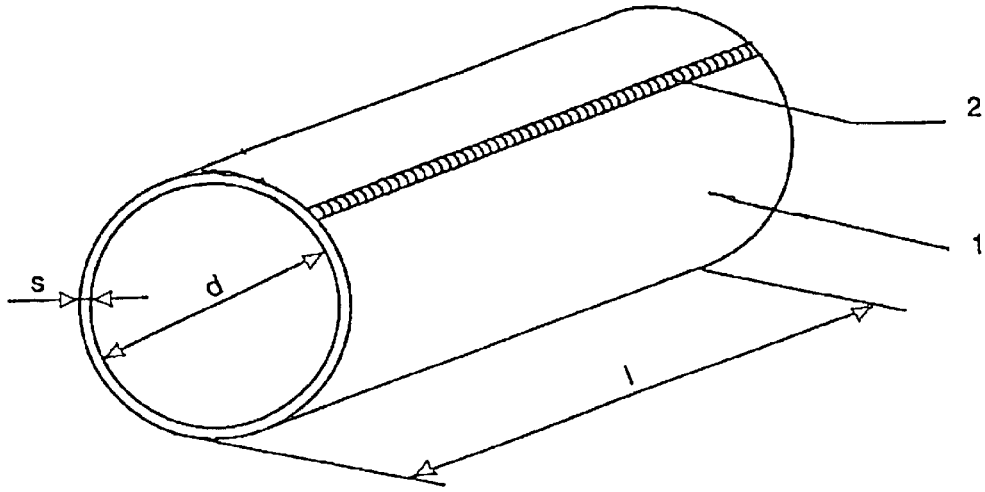
FIG. 1 is a schematic illustration of a metal carrying sleeve pursuant to the present invention.

FIG. 1 shows, in highly schematic fashion, an example of a carrying sleeve 1 of a metal material, which may be aluminum, steel, high-quality steel or brass. The initial form is a rectangular, thin-walled flat sheet, which is bent into the desired hollow cylindrical form. Preferably, the edges of the flat sheet pointing toward one another are permanently connected to one another by means of a welded seam 2.

Figure 2:
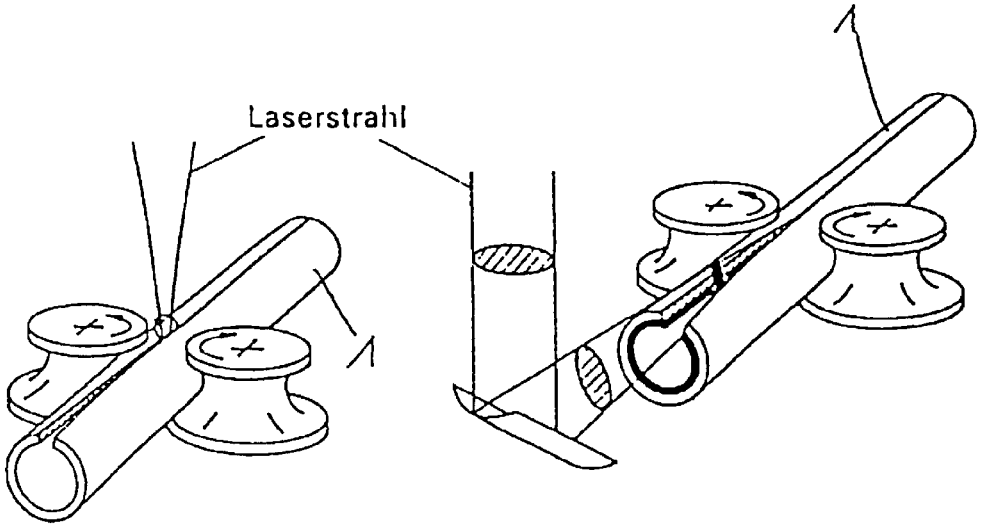
FIG. 2 illustrates a process of welding the tube seam.

FIG. 2 shows possible ways of producing the carrying sleeve 1 in a quasi-continuous fashion, as is currently known by those in the tube welding art. The welding process itself is carried out by a laser beam.. The precision sheets of aluminum, steel, high-quality steel, copper or brass preferably have a wall thickness s of 0.1 to 0.6 mm. The carrying sleeves may also be produced by means of the welding device known from DE 43 11 078.

The external surface of the welded carrying sleeve 1 is then processed to create a homogeneous, continuous outer surface. To carry out this surface processing, it is possible to use known production methods for smoothing a metal surface, such as turning, polishing or the like. In selecting the initial wall thickness of the thin-walled flat sheet, it is necessary to take into account the material that will be removed from the external surface of the welded carrying sleeve during processing.

Figure 3:
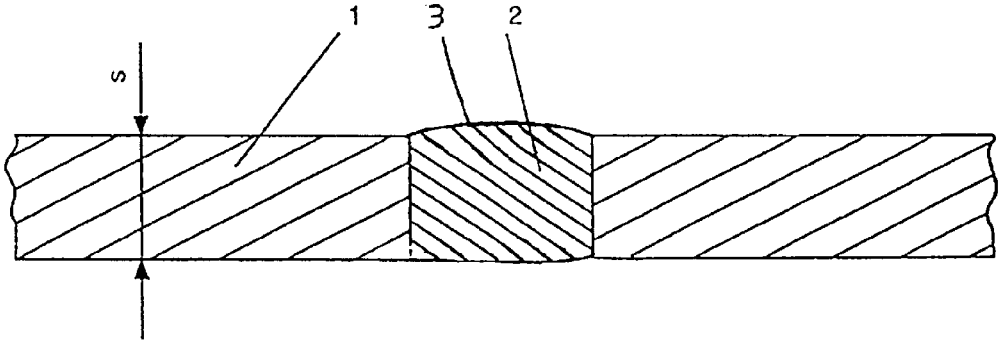
FIG. 3 is a cross section through the weld seam.

As shown in FIG. 3, an especially advantageous embodiment of the welded seam provides a crown 3 on the external surface of the sleeve 1. This crown 3 is then processed in a subsequent process step so that a continuous, endless outer surface is created on the carrying sleeve surface, without any removal of material from the precision metal sheet being necessary or, at least, with only minimal material removal, being necessary.

The crown 3 is attained by welding filler materials, for example, wire or powder, by targeted protective gas feeds, or by deposit welding following the actual welding of the plate edges.

For use in offset printing as the carrying sleeve 1 for a printing form, the entire sleeve surface, including the connecting seam, in the present case a welded seam 2, is subsequently chemically roughened, anodized and provided with a final photosensitive coat, as is already known from the process steps during printing plate production. In respect to technical printing characteristics, this printing form sleeve is identical to conventional printing plates, except that this printing form sleeve permits continuous printing. Preferably, aluminum sheets are used here.

However, it is also possible to apply a water-conducting coat to an aluminum sleeve or another metal sleeve, when the sleeve material itself is not water-conducting but is to be made water-conducting. Ceramic materials, for example, may be applied as water-conducting coats by means of thermal spray processes.

For letterpress printing, especially for flexographic printing, the welded precision sleeve 1, the surface of which is processed as described above, may also be used directly as the carrier of a flexible printing form, rubber stereo or engraved rubber printing form and thus replace the known nickel, fiberglass-reinforced plastic and carbon-fiber-reinforced plastic sleeves.

For use in gravure printing, a metal coat, preferably a copper alloy, is galvanized or sprayed all around on the welded carrying sleeve, the surface of which has been processed as described above, and the metal coat itself is then engraved in a subsequent work step. However, plastic coats may also be applied, which also are engraved upon.

For use in offset printing as a carrying sleeve 1 for a transfer form, the entire processed surface of the sleeve, including the connecting seam 2, is covered by a continuous rubber coat, so that these rubber blanket sleeves are identical to conventional rubber blankets in respect to technical printing characteristics; however, these rubber blanket sleeves make it possible to carry out continuous printing.

The type of rubber coat depends on the particular printing method and is not dependent on the material of the carrying sleeves.

The invention is not limited by the embodiments described above which are presented as examples only but can be modified in various ways within the scope of protection defined by the appended patent claims.

What is claimed is:

1. A metal carrying sleeve for continuous printing a transfer forms, the carrying sleeve consisting essentially of:

a rectangular, thin-walled flat metal sheet, that is bent to a desired hollow cylindrical form so that two edges of the flat sheet face one another;

a metal weld seam that permanently connects together only the facing edges of the sheet so that the sheet is expandable and slidable onto a printing cylinder via pressurized air, the weld seam having an initial crowned configuration formed by deposit welding following an initial welding of the base plate edges; and a homogeneous, continuous and uniform outer circumferential metal surface including the weld seam and formed by processing the surface and the crowned configuration of the weld seam so that one of format variable continuous printing is possible and a layer is placeable on the entire outer circumferential surface, including the weld seam.

2. A carrying sleeve as defined in claim 1, wherein the thin-walled flat sheet is made of aluminum.

3. A carrying sleeve as defined in claim 1, wherein the circumferential surface, including the seam, is chemically roughened and anodized, and further comprising a photosensitive coat on the roughened anodized surface.

4. A carrying sleeve as defined in claim 1, and further comprising a water-conducting coat on the outer surface, including the seam.

5. A carrying sleeve as defined in claim 1, and further comprising an engraved copper coat on the entire outer surface, including the seam.

6. A carrying sleeve as defined in claim 1, and further comprising and endless rubber coat that covers the entire surface, including the seam.

7. A carrying sleeve as defined in claim 1, wherein the carrying sleeve is configured to directly carry a flexible printing form for flexographic printing.

8. A process for producing a carrying sleeve for printing and transfer forms, which sleeve is slidable onto a printing cylinder by expansion by pressurized air, comprising the steps of:

cutting a base plate from thin-walled sheet metal drawn from a roll and in a flat state to a size corresponding to a circumference and breadth of a printing cylinder;

bending the base plate into a desired cylindrical form so that two edges of the base plate face one another;

permanently connecting together the two edges of the base plate with a welded metal seam that has an outwardly directed crown and so that the cylindrical base plate is expandable by pressurized air so that it can be slid onto the printing cylinder wherein the crown is formed by deposit welding following an initial welding of the base plate edges; and processing the crown and an outer surface of the sleeve to form a homogeneous, uniform continuous outer surface formed of the outer sleeve surface and the weld seam so that format variable continuous printing is possible on the entire continuous outer surface.

9. A process for producing an offset printing form, comprising the steps of:

producing a carrying sleeve for printing and transfer forms, which sleeve is slidable onto a printing cylinder by expansion with pressurized air, by cutting a base plate from thin-walled sheet metal drawn from a roll and in a flat state to a size corresponding to a circumference and breadth of a printing cylinder;

bending the base plate into a desired cylindrical form so that two edges of the base plate face one another;

permanently connecting together the two edges of the base plate with a welded metal seam that has an outwardly directed crown and so that the cylindrical base plate is expandable by pressurized air so that it can be slid onto the printing cylinder, wherein the crown is formed by deposit welding following an initial welding of the base plate edges; and processing the crown and an outer surface of the sleeve to form a homogeneous, continuous and uniform outer surface formed of the outer sleeve surface and the weld seam, the processing step including chemically roughening and anodizing the hollow cylindrical form of the base plate and subsequently providing a photosensitive coating on the outer surface of the cylindrical form so as to create a printing form sleeve for format variable continuous printing.

10. A process as defined in claim 9, wherein the base plate is made of aluminum.

11. A process for producing a gravure printing form, comprising the steps of:

producing a carrying sleeve for printing and transfer forms, which sleeve is slidable onto a printing cylinder by expansion with pressurized air, by cutting a base plate from thin-walled sheet metal drawn from a roll and in a flat state to a size corresponding to a circumference and breadth of a printing cylinder, bending the base plate into a desired cylindrical form so that two edges of the base plate face one another, permanently connecting together the two edges of the base plate with a welded metal seam that has an outwardly directed crown and so that the cylindrical base plate is expandable by pressurized air so that it can be slid onto the printing cylinder, wherein the crown is formed by deposit welding following an initial welding of the base plate edges, processing the crown and an outer surface of the sleeve to form a homogeneous, continuous and uniform outer surface formed of the outer sleeve surface and the weld seam; and applying a metal coat to the processed outer surface and then mechanically processing the metal coat.

12. A process as defined in claim 11, wherein the step of applying a metal coat includes applying a copper alloy to the outer surface of the cylinder form.

13. A process for producing a transfer form, comprising the steps of:

producing a carrying sleeve for printing and transfer forms, which sleeve is slidable onto a printing cylinder by expansion with pressurized air, by cutting a base plate from thin-walled sheet metal drawn from a roll and in a flat state to a size corresponding to a circumference and breadth of a printing cylinder, bending the base plate into a desired cylindrical form so that two edges of the base plate face one another, permanently connecting together the two edges of the base plate with a welded metal seam that has an outwardly directed crown and so that the cylindrical base plate is expandable by pressurized air so that it can be slid onto the printing cylinder, wherein the crown is formed by deposit welding following an initial welding of the base plate edges, processing the crown and an outer surface of the sleeve to form a homogeneous, continuous and uniform outer surface formed of the outer sleeve surface and the weld seam; and applying an endless rubber coating to the entire processed sleeve surface.

14. A process for producing a printing form, comprising the steps of:

producing a carrying sleeve for printing and transfer forms, which sleeve is slidable onto a printing cylinder by expansion with pressurized air, by cutting a base plate from thin-walled sheet metal drawn from a roll and in a flat state to a size corresponding to a circumference and breadth of a printing cylinder, bending the base plate into a desired cylindrical form so that two edges of the base plate face one another, permanently connecting together the two edges of the base plate with a welded metal seam that has an outwardly directed crown and so that the cylindrical base plate is expandable by pressurized air so that it can be slid onto the printing cylinder, wherein the crown is formed by deposit welding following an initial welding of the base plate edges, processing the crown and an outer surface of the sleeve to form a homogeneous, continuous and uniform outer surface formed of the outer sleeve surface and the weld seam; and applying an endless ceramic coat to the entire processed sleeve surface.

* * * * *